United States Patent [19]

Boekhaus et al.

[11] Patent Number: 4,884,530

[45] Date of Patent: Dec. 5, 1989

[54] METHOD FOR ADAPTING AN INTERNAL COMBUSTION PISTON ENGINE TO RUN AT OPTIMUM COMPRESSION RATIOS ON A VARIETY OF FUELS REQUIRING DIFFERENT COMPRESSION RATIOS

[75] Inventors: Kenneth L. Boekhaus, Yorba Linda, Calif.; Fred L. Voelz, Munster, Ind.

[73] Assignee: Atlantic Richfield Company, Los Angeles, Calif.

[21] Appl. No.: 125,953

[22] Filed: Nov. 27, 1987

[51] Int. Cl.[4] ..... F02B 75/12

[52] U.S. Cl. ..... 123/1 A; 123/575; 123/525

[58] Field of Search ..... 123/1 A, 26, 525, 90.16, 123/316, 575

[56] References Cited

U.S. PATENT DOCUMENTS

| | | | |
|---|---|---|---|
| 2,817,322 | 12/1957 | Miller | 123/316 |
| 4,060,061 | 11/1977 | Might | 123/26 |
| 4,106,442 | 8/1978 | Miller | 123/26 |
| 4,149,493 | 4/1979 | Franke | 123/26 |
| 4,475,510 | 10/1984 | Asaka et al. | 123/26 |
| 4,480,611 | 11/1984 | Wendt | 123/46 SC |
| 4,495,930 | 1/1985 | Nakajima | 123/1 A |
| 4,527,516 | 7/1985 | Foster | 123/575 |

*Primary Examiner*—E. Rollins Cross
*Attorney, Agent, or Firm*—F. Lindsey Scott

[57] ABSTRACT

A method for combusting fuels selected from the group comprising hydrocarbons, alcohols, hydrogen, disassociated methanol and mixtures thereof in an internal combustion engine at an optimum effective compression ratio for each fuel by changing the effective compression ratio in the engine to an optimum value suitable for each fuel by injecting gas at a pressure selected to produce the desired effective compression ratio so that a variety of fuels requiring different compression ratios can be combusted at an optimum compression pressure for each of the fuels.

6 Claims, 2 Drawing Sheets

METHOD FOR ADAPTING AN INTERNAL COMBUSTION PISTON ENGINE TO RUN AT OPTIMUM COMPRESSION RATIOS ON A VARIETY OF FUELS REQUIRING DIFFERENT COMPRESSION RATIOS

This invention relates to internal combustion piston engines.

This invention also relates to a method for adapting an internal combustion piston engine to run at an optimum compression ratio (optimum maximum compression pressure) on a variety of fuels having varying octane ratings.

Today's automobiles are powered by internal combustion engines. The majority of such engines are spark-ignited, use gasoline as a fuel, and employ either natural aspiration or injection as the fuel delivery system. In some cases, turbo chargers have been used to increase the volume of air intake and the maximum compression pressure under specific operating conditions to increase engine output. The engine's design characteristics such as compression ratio, valve overlap, and the like, determine the fuel specifications, ignition profile and air-to-fuel ratios for optimum economy and performance. Adjusting the spark timing, idle air-to-fuel ratio and other parameters offer some degree of fine tuning for fuel and engine variations but major changes in fuel characteristics cannot be tolerated without sacrificing performance and efficiency. While engines can be equipped to operate singly on two or more different fuels, the performance using at least one of the fuels will be less than optimum since the basic engine design will not be correct for one of the fuels. Although some engine parameters such as spark and idle fuel-to-air ratio can be adjusted by auxiliary means, the compression ratio is set by the engine design and cannot be adjusted to the optimum value for each fuel. Currently, the most commonly used two fuel system is the conventional gasoline engine being operated on gasoline and compressed natural gas or liquified petroleum gas. These engines run on either gasoline or compressed natural gas and require a separate fuel tank and delivery system for each type of fuel. Switching from one fuel to the other can be configured to incorporate a modification of the ignition system's performance characteristics to approximate the requirements for the fuel.

Although dual fuel systems using gasoline and compressed natural gas or liquified petroleum gas are available, no dual fuel systems using significantly different liquid fuels either mixed in a single tank or supplied from separate fuel tanks are currently commercially available. Different liquid fuels in this context include combinations such as alcohols and gasoline although many liquid and gaseous fuels such as liquid hydrocarbons, gaseous hydrocarbons, liquified petroleum gas, methanol, disassociated methanol, hydrogen and the like may be used in such dual fuel systems. Research has been directed to the development of a system which would allow an engine to run on alcohol while maintaining the possibility of running on a second alternative fuel, such as gasoline. This work has been extended and refined so that the fuel flows through the system's measuring and control device to produce a signal to the engine's computer control which is then processed to provide a proper fuel volume and ignition spark advance. Additional control of the fuel volume is provided by the vehicle's exhaust gas oxygen sensor which also provides a signal to a computer. Because the fuel is measured at the engine and the fuel volume and spark advance are controlled by the onboard computer, variations in the fuel composition, even such extreme variations as changes from gasoline to methanol, are readily controlled. Such developments are considered to be known to those skilled in the art.

A major problem with both the above systems is that the engine cannot be designed to give optimum performance for each fuel. The optimum compression ratio (optimum maximum compression pressure) for compressed natural gas, liquified petroleum gas, methanol and gasoline are not the same. As a result, engine operation when running on one of the fuels will not be as good as that when running on the fuel for which the engine was designed.

According to the present invention, this disadvantage is overcome by adjusting the volume of air entering the engine to provide the engine with a maximum compression pressure that corresponds to the optimum compression ratio for the fuel being used.

In the discussion of the FIGURES, the same numbers will be used to refer to the same or similar components throughout.

Figure 1:
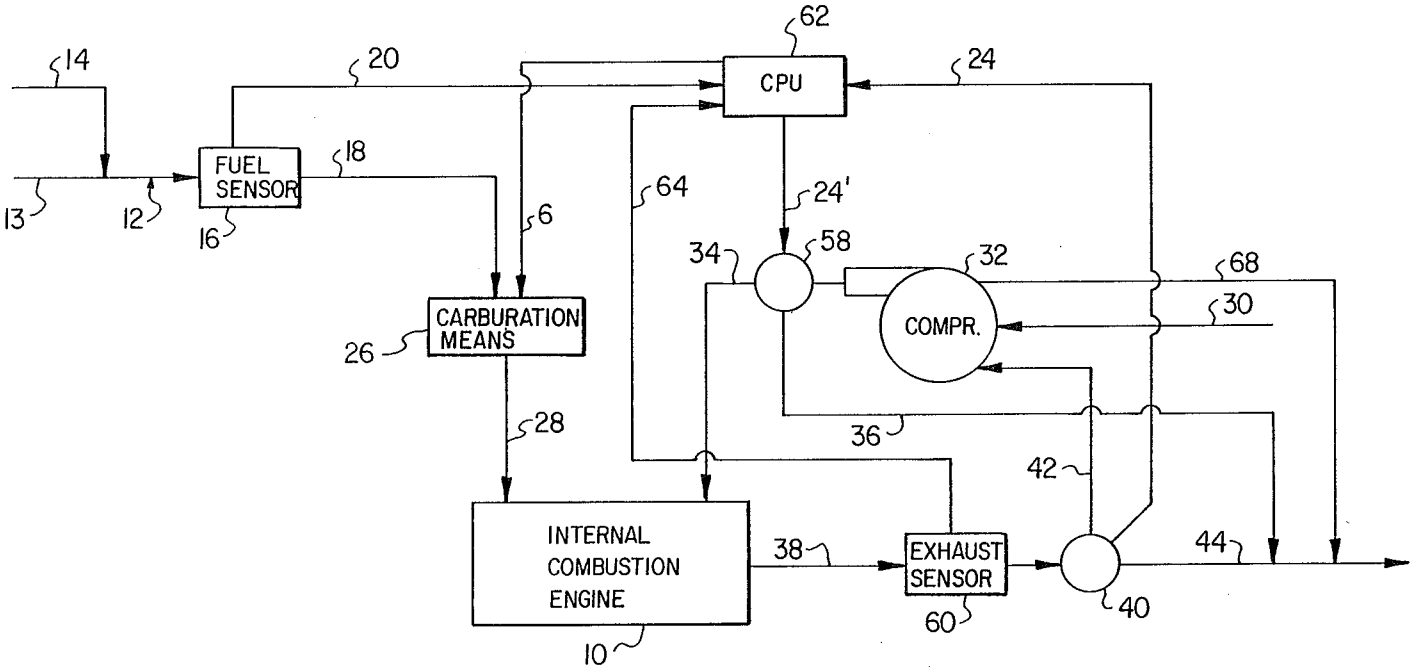
FIG. 1 is a schematic diagram of an embodiment of the present invention.

In FIG. 1, an internal combustion engine 10 is shown. Fuel is supplied to engine 10 through a line 12. The fuel supplied to engine 10 through a line 13 and line 12 can be considered to be the fuel, such as gasoline, for which the engine was designed and with which the engine should give optimum performance. The fuel supplied through line 14 is an alternate fuel such as compressed natural gas, liquified petroleum gas, alcohols, or the like. The fuel is passed through a sensor 16 which determines the fuel composition (i.e., type or types of and the proportion of each fuel in line 12) and generates a signal which is sent to an onboard computer 62 via a line 20 where it is used in combination with other signals such as the signal from an exhaust gas sensor 60, to adjust the spark timing, air-to-fuel ratio and the effective compression ratio as described below. The fuel then passes through a line 18, a suitable carburetion means 26 and a line 28 to engine 10. It will be understood that carburetion means 26 could be a carburetor for liquid fuels, fuel injector means, means for controlling the inlet pressure of gases, or the like as required for any of the fuels charged to engine 10. Exhaust gas from engine 10 is passed through an exhaust 38, exhaust gas sensor 60, a waste gate valve 40 and an exhaust discharge line 44. The air-to-fuel ratio in engine 10 is controlled by onboard computer 62 or other suitable means in response to a signal from sensor 16 via a line 20 or a manual setting indicating the change in fuels in combination with other operational signals such as the signal from exhaust gas sensor 60. A signal from exhaust gas sensor 60 is passed to computer 62 via a line 24. As shown in FIG. 1, the control is from computer 62 in response to signals from sensor 16 or a manual setting via line 20 and exhaust gas sensor 60 via line 24. The amount of oxygen in the exhaust gas is frequently used as a control parameter. Air passed to compressor 32 through a line 30 is compressed and discharged from compressor 32 through a valve 58 and a line 34 to engine 10 as directed by computer 62. A portion of the compressed gas may be diverted by valve 58 through a line 36 to exhaust line 44 if desired. As shown, compressor 32 is driven by exhaust gas from exhaust line 44 which is passed to compressor 32 via a line 42 and discharged from compressor 32 via a line 68 to exhaust line 44. Such gas driven compressors typically run continuously with the compressed air being directed to engine 10, exhaust line 44 or discharged. The air-to-fuel ratio is controlled by a signal from computer 62 to carburetion means 26 via a line 66. Similarly the amount of air passed to combination with the exhaust in line 44 via a line 42 is controlled by a signal from computer 62.

Figure 2:
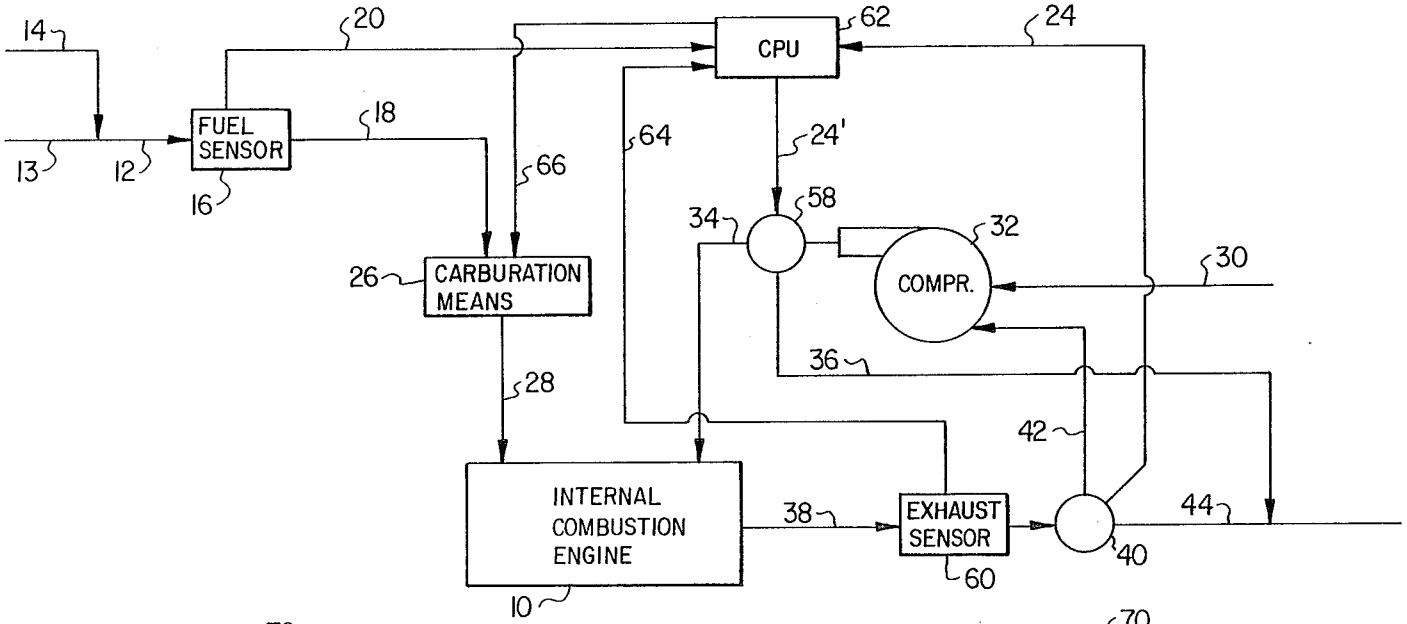
FIG. 2 is a schematic diagram of an alternative embodiment of the present invention.

In FIG. 2 a similar engine is shown except that compressor 32 is mechanically or electrically driven. Such compressors do not run continuously so no air discharge to the atmosphere, etc. is necessary unless excess compressed gas is produced in conjunction with the production of gas for passage to the exhaust gas or the like.

In the practice of the present invention, the compression ratio which is defined as the volume swept by the piston in a cylinder, plus the combustion space volume divided by the combustion space volume is effectively varied by charging air at an increased pressure and volume to engine 10 to accomplish a desired maximum compression pressure. The compression ratio is defined by an equation:

$$CR = \frac{C + D}{D}$$

where CR represents the compression ratio; C equals the volume swept by the piston in one stroke and D equals the combustion space volume. Clearly the compression ratio is a function of the engine design, but by the present invention the effective compression ratio is varied by injecting compressed gas prior to compression to produce a desired maximum compression pressure.

Figure 3:
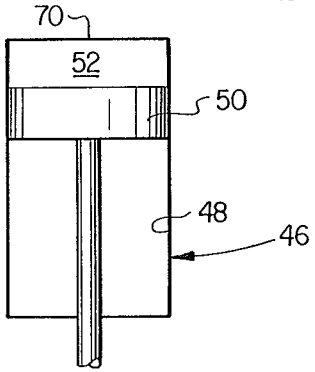
FIG. 3 is a schematic diagram of a piston at its top dead center position.

In FIG. 3, a piston 50 is shown in a cylinder 46 at its top dead center position. The combustion space volume 52 is the space enclosed by the piston, the top of the cylinder 70 and the cylinder walls 48 at top dead center position and is generally near the volume at which combustion occurs in the cylinder.

Figure 4:
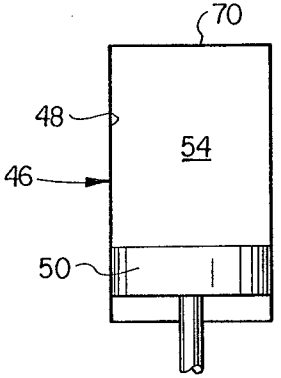
FIG. 4 is a schematic diagram of a piston in its bottom dead center position.

FIG. 4 shows a piston 50 in a cylinder 46 at its bottom center position and defines a volume 54 which represents the volume swept by the piston in one stroke plus the combustion space volume 52. This is the volume into which the combustion gas and fuel are injected prior to compression. As well known to those skilled in the art, the actual compression ratio is less than that calculated using the above equation due to intake valve timing restrictions in the air flow system, engine speed, and other factors. The operating compression ratio is the volume of air aspirated by the piston plus the combustion space volume divided by the combustion space volume. Such engines are normally operated in environments which are at or near atmospheric pressure. Increasing the pressure of the air entering the cylinder relative to the engine's environment will cause the volume of air entering the cylinder to be increased. This increased volume causes the effective compression ratio, i.e., the maximum compression pressure to be increased. In operation, the engine is designed to run efficiently on the fuel requiring the lower compression ratio. When the fuel is switched to the second fuel, a control system activates the air-control system to increase the volume of air aspirated by the engine. By increasing the volume of air aspirated, the effective compression ratio is increased. This increased volume of air can be differentially controlled by engine load factors. According to the present invention, sensor 16 in conjunction with sensor 60 generates a signal which is used by a control system (computer 62) to increase the amount of gas entering the cylinder through line 34. The injection ratio of gas and fuel is also controlled by computer 62 so that the air-to-fuel ratio is maintained at a desired level. The pressure and volume of the gas injected is varied as necessary to accomplish the desired optimum compression pressure, i.e., a sufficient volume of air is injected to result in the production of the desired compression pressure for each fuel. By thus varying the effective compression ratio, the engine can be operated at its optimum effective compression ratio for each fuel or fuel blend. The system will respond to continuing changes in the fuel mixture. As previously discussed, means are available to the art for varying other conditions to accomplish optimum operation for the engine. The control of the air-to-fuel ratio, spark advance, and the like are known to those skilled in the art, however; without a suitable variation in the effective compression ratio, optimum conditions cannot be accomplished for fuels requiring a compression ratio, i.e., maximum compression pressure different than that for which the engine was initially designed. Obviously, the compression ratio for a given piston and cylinder system is defined by the geometry of the system. According to the present invention, the effective compression ratio can be varied by increasing the amount of air injected.

By way of illustration, it is desirable that engines designed to run on gasoline be able to run on compressed natural gas while still retaining the ability to run on gasoline. The compression ratio for the basic engine operated on gasoline is of the order of 9 to 1 and uses a correct air-to-fuel ratio of a nominal 14 to 1. To operate this engine efficiently on compressed natural gas, the compression ratio should be on the order of 14 to 1 and the air-to-fuel ratio should be a nominal 17 to 1. Since the compression ratio is a function of engine design (i.e., the volume swept by the piston plus the dead volume divided by the dead volume), it cannot be changed when switching to compressed natural gas. By the present invention, the effective compression ratio can be increased. When the switch is made to compressed natural gas, a signal is sent to the air control system which increases the volume of air charged to the engine. This added air causes the pressure at the end of the compression stroke (maximum compression pressure) to be increased to a value equivalent to that present in a higher compression ratio engine. According to the present invention, the engine will then operate in an optimum manner on compressed natural gas. The correct air-to-fuel ratio, ignition timing, and the like, required for the different fuel can be controlled by an on-board computer as known to those skilled in the art and does not warrant further discussion.

In the operation of an engine which is to be operated on gasoline and methanol, a sensor 16 can be used to determine which of the fuels is used. Such sensors can also be equipped to provide a signal indicative of a mixture of such fuels. The signal is then used to control the volume of added air or other gas. This also permits adjustment of the compression ratio to a desired value. The other values that are required for optimum operation are similarly controlled as discussed previously. The variation of the air-to-fuel ratio has been discussed with reference to air although it should be recognized that oxygen-containing streams in general could be used if desired. The use of air is by far the most common means for providing oxygen to an internal combustion engine.

Having discussed the invention by reference to certain of its preferred embodiments, it is respectfully pointed out that many variations and modifications are possible within the scope of the present invention. Such variations and modifications may appear obvious and desirable to those skilled in the art based upon a review of the foregoing description of the preferred embodiments.

Having thus described the invention, we claim:

1. A method for combusting a fuel selected from a group of fuels requiring different maximum compression pressures, said group of fuels consisting of hydrocarbons, alcohols, hydrogen, disassociated methanol and mixtures thereof in a combustion chamber enclosed by a piston in a cylinder at optimum combustion conditions, said method consisting essentially of:

(a) selecting a fuel;

(b) inducting said selected fuel into said cylinder;

(c) injecting a quantity of an oxygen-containing gas into said cylinder to produce a combustion mixture of said selected fuel and said oxygen-containing gas, said gas being injected at a pressure and volume sufficient to produce the optimum maximum compression pressure desired for combustion of said selected fuel upon compression in said cylinder.

2. The method of claim 1 wherein said oxygen-containing gas is air.

3. The method of claim 2 wherein said air and said selected fuel are inducted at a selected air-to-fuel ratio.

4. In a method for combusting a fuel selected from the group comprising hydrocarbons, alcohols and mixtures thereof in a combustion chamber enclosed by a piston in a cylinder wherein a selected fuel is inducted into said cylinder with a selected quantity of a gas comprising air to produce a combustion mixture of said selected fuel and air at a selected air-to-fuel ratio and compressed by said piston to a maximum compression pressure fixed by the reduction in volume of said gas by movement of said piston in said cylinder, and improvement comprising increasing the maximum compression pressure in said combustion chamber to a value suitable for a second selected fuel by injecting said gas at a pressure selected to produce the optimum maximum compression pressure upon compression by said piston so that a variety of said fuels requiring different maximum compression pressures can be combusted at an optimum maximum compression pressure selected for each of said fuels in said combustion chamber.

5. An internal combustion piston engine adapted to run at optimum maximum compression pressure conditions on fuels selected from hydrocarbon fuels, alcohols, and mixtures thereof, said engine comprising:

(a) an engine adapted to compress and combust a selected fuel in at least one combustion chamber enclosed by a piston in a cylinder;

(b) a fuel supply system in communication with said engine for supplying said fuel to said engine;

(c) a selector system in communication with said fuel supply system for changing the fuel supplied to said engine via said fuel supply system;

(d) a compressor means positioned to charge a compressed gas comprising air to said engine;

(e) a control system for controlling the quantity of said gas charged to said engine to produce a maximum compression pressure in said engine in a range selected for the fuel supplied to said engine; and (f) an exhaust means positioned to discharge exhaust gas from said engine.

6. The engine of claim 5 wherein said engine includes a fuel sensor means in communication with said fuel supply system, for identifying the type of fuel supplied to said engine and wherein the quantity of gas charged to said engine is in response to a signal supplied to said control system from said fuel sensor.

* * * * *